United States Patent [19]

Wikkerink

[11] Patent Number: 4,727,822

[45] Date of Patent: Mar. 1, 1988

[54] FLAG STAFF

[76] Inventor: Lance Wikkerink, 4908 62nd Ave. S., St. Petersburg, Fla. 33707

[21] Appl. No.: 902,490

[22] Filed: Sep. 2, 1986

[51] Int. Cl.[4] ..... G09F 17/00

[52] U.S. Cl. ..... 116/174; 116/28 R

[58] Field of Search ..... 116/173–175, 116/28 R; 40/606, 607, 591, 592, 493, 218, 602, 613; 446/217, 218, 236, 176; 273/413, 414; 73/188; 248/521, 415

[56] References Cited

U.S. PATENT DOCUMENTS

| | | | |
|---|---|---|---|
| 938,221 | 9/1908 | Dallimore | 116/173 |
| 1,312,426 | 8/1919 | Schmidt | 116/173 |
| 1,547,416 | 7/1925 | Edwards | 116/173 |
| 1,728,079 | 9/1929 | Power | 116/173 |
| 2,441,875 | 5/1948 | Faber | 116/173 |
| 3,049,008 | 8/1962 | Polster | 73/188 |
| 3,119,370 | 1/1964 | Keats | 116/173 |
| 3,127,869 | 4/1964 | Howland | 116/173 |
| 4,227,406 | 10/1980 | Coffey | 73/188 |
| 4,583,310 | 8/1986 | Seiler | 40/592 |

FOREIGN PATENT DOCUMENTS

| | | | |
|---|---|---|---|
| 2251107 | 5/1974 | Fed. Rep. of Germany | 446/217 |
| 1097491 | 7/1955 | France | 116/173 |

*Primary Examiner*—Charles Frankfort
*Assistant Examiner*—W. Morris Worth
*Attorney, Agent, or Firm*—Walter J. Monacelli

[57] ABSTRACT

The flagstaff described herein comprises a hollow flag holding unit or sleeve preferably cylindrical in shape, capped at one end and having a longitudinal slot running at least a substantial portion of the length of the flag holding unit adapted to have a stiff, stitched or raised edge of a flag inserted into the holding unit with the flag extending through the slot with the major portion of the flag extending outside the holding unit. With flag in position the capped holding unit is positioned on a vertical staff with the cap resting on the top end of the staff. The flag edge will be retained in a straight line and the holding unit will rotate as the wind direction changes so that the flag will not wrap around the supporting means.

7 Claims, 7 Drawing Figures

FLAG STAFF

BACKGROUND OF THE INVENTION

1. Field of the Invention

This invention relates to a flag holding device which prevents wrapping of the flag around the supporting pole. More specifically, it relates to a flag holding device, capped at one end and having a longitudinal slot in which the flag may be held and a vertical staff on which the capped end of the holding unit is rested so that, as the wind shifts, the flag unit will rotate accordingly.

2. State of the Prior Art

Faber U.S. Pat. No. 2,441,875 shows a trainman's safety signal flag device of an extensible and retractable character whereby the same can be collapsed telescopically and compactly into relatively short length for storage. The flag holding portion has a longitudinal slot and the flag has a raised edging to be fitted into the interior of the flag holding portion with the flag extending through the longitudinal slot. However the flag holding portion is not rotatable and the flag is shown wrapped around the flag holding portion.

Keats U.S. Pat. No. 3,119,370 describes a flagstaff adapted to be readily assembled and dissembled. One portion comprises a slot portion into which an edge of the flag is held. This flag holding unit also has a doubly recessed portion which fits into a longitudinal slot of the flagstaff. There is no provision for rotation of the flag holding portion in accordance with shift in wind direction. Consequently there is no provision to avoid wrapping of the flag around the supporting post.

Schmidt U.S. Pat. No. 1,312,426 discloses a pair of telescoping tubes so arranged that the flag secured to the inner tube can be wrapped around the inner tube and readily inserted into the outer tube for storage. Here again there is no provision for rotation of the flag holding portion with changes in wind direction so here again the flag may wrap itself around the flag supporting tube.

Dallimore U.S. Pat. No. 938,221 shows another flag storage device which has an interior shaft or spindle to which the flag is attached. Although this interior shaft is rotatable, this is for the purpose of drawing the flag into the interior and not for the purpose of changing the position of the flag with change in wind direction. Therefore there is no provision to avoid having the flag wrap around the outer shaft.

OBJECTIVES OF THIS INVENTION

It is an objective of this invention to provide a flagstaff which avoids wrapping of the flag around the flagstaff.

It is also an objective of this invention to provide a flagstaff which is rotatable with change in wind direction.

SUMMARY OF THE INVENTION

In accordane with the present invention a flagstaff or flag holding device has been designed in which a flag holding unit will turn or rotate on its linear axis with each change in wind direction, so that wrapping of the flag around its holding unit is avoided. In this device the flag holding unit comprises a hollow sleeve, preferably cylindrical in shape, capped at one end thereof and having a length at least as long as the edge of the flag to be held therein. This hollow, capped sleeve has a slot therein parallel to the linear axis of the sleeve and preferably no longer or not much longer than the edge of the flag to be inserted therein. This edge of the flag preferably has a thickness or raised portion greater than the width of the slot so as to prevent this edge from passing through the slot when this edge is inserted into the interior of the hollow holding device with the remainder of the flag extending through and outside the slot. It is comtemplated also that this raised edge may also be of a thickness approximately equal to the width of the slot so that this raised edge may be inserted into and pulled into the slot so as to give a tight, snug fit in the slot.

In the flag holding operation, the hollow flag holding unit is slipped over a substantially vertical staff having a diameter smaller than the diameter of the free space within the flag holding unit. The inside bottom surface of the capped end of the holding unit is rested on and supported on the top end of the staff. The top end of the staff may comprise a rounded surface or a sphere or a hemisphere so that the area of contact between the top of the staff and the underside of the cap will be a minimum and thereby offer little friction or resistance against the rotation of the flag holding unit.

Generally the interior diameter of the flag holding unit is not much more than required to accommodate the staff and the raised edge of the flag in the hollow space of the holding unit. This will guard against having the top of the staff in off-center contact with the underside of the cap. In some cases, it may be desirable to have an indentation on the underside of the cap to receive the top of the staff and thereby avoid having the contact area between the staff and the cap being away from the center of the cap. In such case, however, care should be taken that such increase in contact area will not increase the friction between the staff and cap so as to impede the free rotation of the flag holding unit around the linear axis of the shaft.

While the configuration of the sleeve or flag holding unit is preferably cylindrical, it is also contemplated that other configurations may be used in which the cross sections are other than circular, such as oval or elliptical, triangular, etc., or combinations thereof.

The flag staff preferably has a base or platform only a short distance below the lower end of the sleeve or hollow flag holding unit so that, if the flag should slip down in the slot, it will be prevented from escaping from the flag holding unit. This platform may comprise the base on which the staff stands or rests or it may be fixed at the appropriate position on a longer staff which extends much lower than the flag holding unit. This support may be non-rotatable about the staff but is preferably rotatable about the axis so that if the lower end of the edge of the flag rests on this platform, the resistance to rotation of the flag holding unit about the staff will be minimized.

SPECIFIC DESCRIPTION OF THE INVENTION

The description of the flagstaff of this invention is simplified by reference to the drawings.

Figure 1:
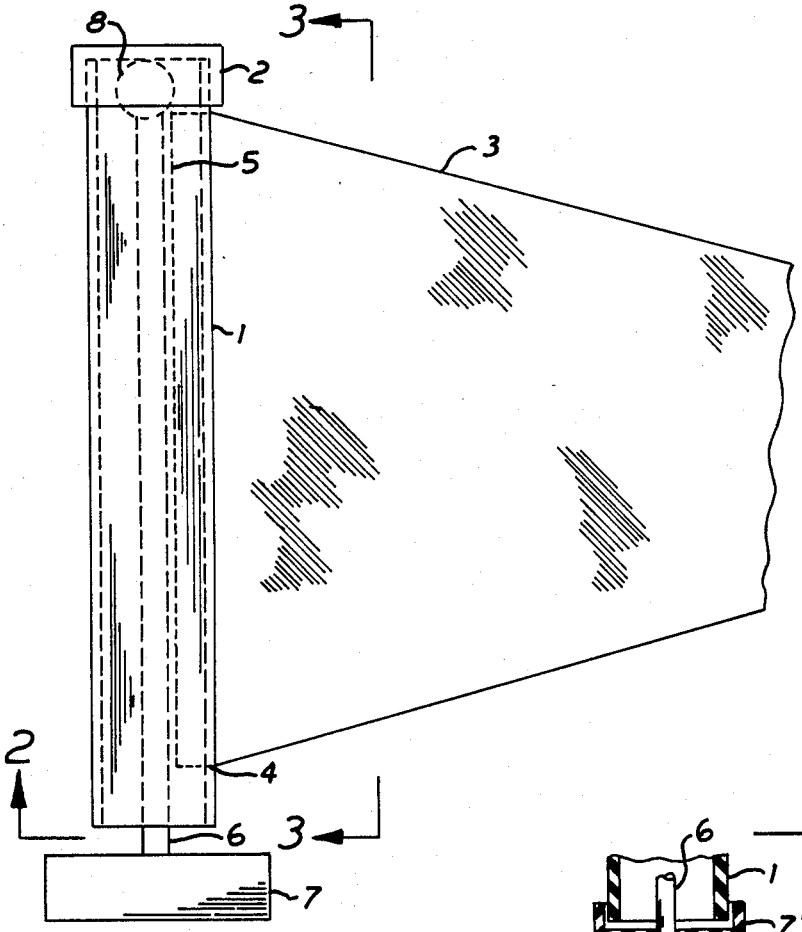
FIG. 1 is a front elevational view of a preferred modification of the flagstaff of this invention.

More specifically, FIG. 1 shows cylindrical flag holding unit 1 with cap 2 affixed at the top thereof. Flag 3 extends through slot 4 with stitched or raised edge 5 of flag 3 inside the flag holding unit 1 and preventing the edge from coming through slot 4. Staff 6 extends upward above platform 7 and supports cap 2, the bottom side of which rests on the sphere 8 at the top of staff 6. Platform 7 is positioned only a short distance below the bottom of holding unit 1 so that if the flag 3 slips downward, it will rest on platform 7 and thereby be prevented from sliding any further downward.

Figure 3:
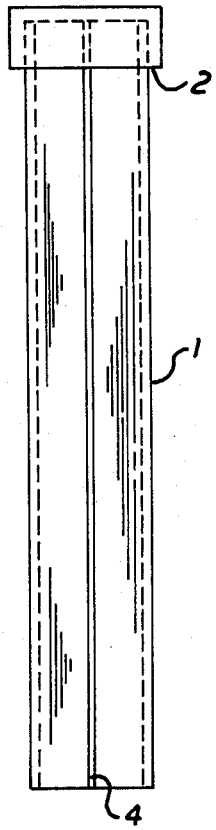
FIG. 3 is a side elevational view of the hollow flag holder unit of the flagstaff taken at line 3—3 of FIG. 1.
Figure 2:
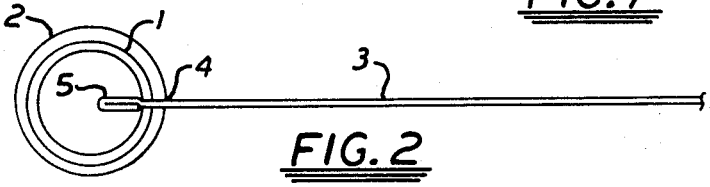
FIG. 2 is a bottom view of the hollow flag holding unit taken upward at line 2—2 of FIG. 1.
Figure 5:
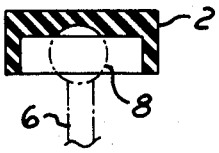
FIG. 5 is a cross-sectional view of the cap portion of a modification of this invention in which the interior bottom surface of the cap has an indentation therein.

FIGS. 2 and 3 show the same elements of the modification of FIG. 1.

Figure 4:
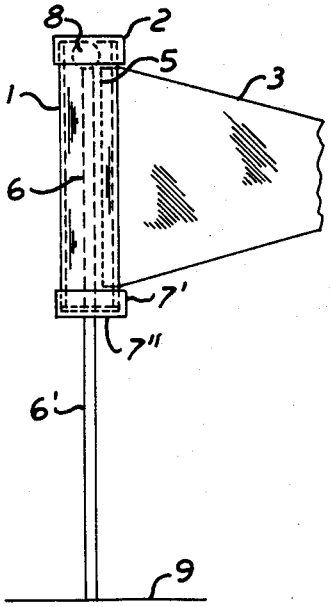
FIG. 4 is a front elevational view of a modification of the flagstaff of this invention in which the staff portion is longer and extends a considerable distance below the flag holding unit.

The flag modification shown in FIG. 4 has a long staff in which the portion 6′ extends well below the flag holding unit 1. In this case platform 7′ comprises a cup having the open portion extending upward with the inside bottom 7″ thereof a short distance below the lower edge of the sleeve or flag holding unit 1 and therefore free to rotate on its axis. The lower part of staff 6′ is attached to supporting means 9.

Figure 6:
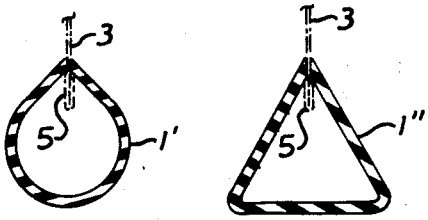
FIG. 6 shows cross-sectional views of two modifications in which the hollow flag holding unit has in one case a combined circular-triangular cross-sectional configuration and in another case a triangular configuration.

FIG. 6 shows cross-sectional views of two optional or alternative configurations of the sleeve that may be used in place of the cylindrical sleeve shown in FIGS. 1–4. The first cross-section is one having the outer shell 1′ partially circular and the remainder resembles the apex of a triangle. The other cross-section is one having a triangular outer shell 1″. Other configurations may also be used.

Figure 7:
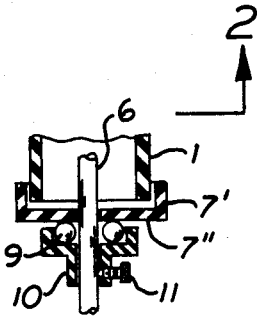
FIG. 7 is a cross-sectional view of a platform positioned below the lower end of the sleeve or flag holding unit.

FIG. 7 illustrates a rotatable platform for positioning at or below the lower edge of sleeve 1. Platform 7′ is of the cup type shown in FIG. 4. Platform 7″ is rotatably supported on ball bearings 9 which run in supporting track 10. Track 10 is fixed in position on shaft 6 by tightening screw 11.

The flagstaff of this invention is particularly useful on boats but may be used on other vehicles, such as automobiles and trucks, and on houses and other buildings.

While certain features of this invention have been described in detail with respect to various embodiments thereof, it will of course be apparent that other modifications can be made within the spirit and scope of this invention, and it is not intended to limit the invention to the exact details shown above except insofar as they are defined in the following claims.

The invention claimed is:

1. A flagstaff comprising the combination of a tubular sleeve having an upper end and a lower end and a longitudinal axis, wherein said sleeve being provided with a cap having a bottom interior surface, said cap covering the upper end of said sleeve, said sleeve having a hollow interior, and a slot communicating with said hollow interior and running longitudinally over a substantial length of said sleeve parallel to the longitudinal axis of said sleeve; and (b) a generally stationary supporting staff having a linear axis and an upper end, said staff extending substantially vertically and adapted to fit into the interior of said sleeve whereby the bottom surface of said cap rests upon the upper end of said supporting staff in a manner so that the sleeve is free to rotate about the linear axis of said supporting staff.

2. The flagstaff of claim 1 in which said slot is wide enough to allow a main portion of a flag to pass therethrough but thin enough to prevent a thickened edge of said flag from passing therethrough.

3. The flagstaff of claim 2 in which said supporting staff has a platform positioned thereon a short distance below the lower end of said sleeve when said cap of said sleeve rests upon the upper end of said supporting staff, said platform having a width greater than that of the lower end of said sleeve.

4. The flagstaff of claim 2 in which said supporting staff has a rotatable platform positioned thereon a short distance below the lower end of said sleeve when said cap of said sleeve rests upon the upper end of said supporting staff, said platform having a width greater than that of the lower end of said sleeve.

5. The flag staff of claim 1 in which the upper end of said supporting staff is rounded.

6. The flagstaff of claim 5 in which the upper end of said supporting staff is a sphere.

7. The flagstaff of claim 5 in which the said cap has an indentation centrally in the bottom interior surface thereof.

* * * * *